US010770212B2

(12) United States Patent
Aydt et al.

(10) Patent No.: US 10,770,212 B2
(45) Date of Patent: Sep. 8, 2020

(54) DETERMINING ARMATURE STROKE BY MEASURING MAGNETIC HYSTERESIS CURVES

(71) Applicant: Robert Bosch GmbH, Stuttgart (DE)

(72) Inventors: Gerald Aydt, Koenigsbach-Stein (DE); Klemens Steinberg, Vaihingen/Enz-Enzweihingen (DE); Marco Beier, Leonberg (DE); Markus Rueckle, Stuttgart (DE); Oezguer Tuerker, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 306 days.

(21) Appl. No.: 16/065,001

(22) PCT Filed: Nov. 28, 2016

(86) PCT No.: PCT/EP2016/079028
§ 371 (c)(1),
(2) Date: Jun. 21, 2018

(87) PCT Pub. No.: WO2017/108342
PCT Pub. Date: Jun. 29, 2017

(65) Prior Publication Data

US 2019/0006073 A1 Jan. 3, 2019

(30) Foreign Application Priority Data

Dec. 21, 2015 (DE) ..... 10 2015 226 189

(51) Int. Cl.
*H01F 7/18* (2006.01)
*F02D 41/20* (2006.01)
(Continued)

(52) U.S. Cl.
CPC ..... *H01F 7/1844* (2013.01); *F02D 41/20* (2013.01); *F02D 41/2432* (2013.01);
(Continued)

(58) Field of Classification Search
CPC ... F01L 9/04; F02M 25/0836; F16K 31/0693; F16K 31/0627; F16K 31/0613;
(Continued)

(56) References Cited

U.S. PATENT DOCUMENTS

2013/0169287 A1* 7/2013 Fink ..... H01H 47/325 324/511

FOREIGN PATENT DOCUMENTS

DE 102010063009 A1 6/2012
DE 102012206484 A1 10/2013
(Continued)

OTHER PUBLICATIONS

International Search Report with English translation and Written Opinion for Application No. PCT/EP2016/079028 dated Feb. 3, 2017 (15 pages).

*Primary Examiner* — Bryan R Perez
(74) *Attorney, Agent, or Firm* — Michael Best & Friedrich LLP

(57) ABSTRACT

The invention relates to a method for producing a valve (1) that can be electromagnetically actuated which method comprises an electromagnet (2, 2*a*, 2*b*), an armature (3) that can be moved by the electromagnet (2, 2*a*, 2*b*), and a valve body (5), having means (4, 4*a*, 4*b*, 4*c*) for converting a movement of the armature (3) into an opening or closing of the valve (1), wherein the electromagnet (2, 2*a*, 2*b*) and the armature (3) are inserted into the valve body (5), wherein, before the electromagnet (2, 2*a*, 2*b*) is inserted into the valve body (5), a magnetic hysteresis curve (10) of a combination (6) of the electromagnet (2, 2*a*, 2*b*) having a test armature (3*a*) lying against said electromagnet (2, 2*a*, 2*b*) is recorded, the slope $m_1$ of a first, substantially linear curve segment (11) of the hysteresis curve (10) is determined in the unsaturated state, and, from the slope $m_1$, the slope $m_1$* of a curve segment (31) of a hysteresis curve (30) of the finally
(Continued)

assembled valve (1) having the armature (3) lying continuously against the electromagnet (2, 2*a*, 2*b*) is determined, said curve segment corresponding to the first curve segment (11). The invention further relates to a method for determining the armature stroke AH, wherein the magnetic energy ΔE in the air gap (9) formed between the armature (3) and the electromagnet (2, 2*a*, 2*b*) is evaluated from the difference between the first slope $m_0$ and the second slope $m_1$*.

15 Claims, 6 Drawing Sheets

(51) Int. Cl.
*F02D 41/24* (2006.01)
*F02M 65/00* (2006.01)

(52) U.S. Cl.
CPC ..... *F02D 41/2467* (2013.01); *H01F 7/18* (2013.01); *F02M 65/00* (2013.01); *H01F 2007/1855* (2013.01); *H01F 2007/1861* (2013.01)

(58) Field of Classification Search
CPC ..... F16K 31/0675; F16K 31/0655; H01F 2007/1861; H01F 7/1646; H01F 7/13; H01F 7/1844; B60T 8/367; F02D 41/20
See application file for complete search history.

(56) References Cited

FOREIGN PATENT DOCUMENTS

| | | | |
|---|---|---|---|
| DE | 102013223121 | A1 | 5/2015 |
| WO | 2016083050 | A1 | 6/2016 |

* cited by examiner

DETERMINING ARMATURE STROKE BY MEASURING MAGNETIC HYSTERESIS CURVES

BACKGROUND OF THE INVENTION

The present invention relates to a method for determining the armature stroke at an electromagnetically actuatable valve and a method for producing such a valve.

In modern fast-switching electromagnetic valves, as are used in diesel injection valves, for example, accurate knowledge or setting of the armature stroke is necessary for an ideal functionality of the valve. The armature stroke should lie between a lower threshold and an upper threshold. There is throttling of the valve if the armature stroke is too small. Closure bounces may increasingly occur if the armature stroke is too large.

DE 10 2012 260 484 A1 and DE 10 2013 223 121 A1 have disclosed electromagnetic fuel injectors with measurement systems for the armature stroke. These measurement systems transfer the stroke movement of the armature, respectively with additional transfer elements, to a measuring device.

SUMMARY OF THE INVENTION

A method for producing an electromagnetically actuatable valve from an electromagnet, an armature that is movable by way of the electromagnet, and a valve body was developed in the context of the invention. The valve body contains means for converting a movement of the armature into opening or closing of the valve. The electromagnet and the armature are inserted into the valve body.

According to the invention, a magnetic hysteresis curve of a combination of the electromagnet with a test armature contacting said electromagnet is recorded prior to inserting the electromagnet into the valve body. The slope $m_1$ of a first, substantially linear curve portion of the hysteresis curve in the unsaturated state is ascertained. Here, the test armature preferably has the same dimensions and the same magnetic properties as the armature of the valve.

The slope $m_1$* of a curve portion, corresponding to the first curve portion, of a hysteresis curve of the fully assembled valve with an armature permanently in contact with the electromagnet is ascertained from the slope $m_1$.

The electromagnet and the armature together form a magnetic circuit with a magnetic flux Ψ that, for example, can be determined directly by way of an additional measuring coil or indirectly by integrating the voltage $U_{ind}=U_K-I\cdot R$ induced in the electromagnet over time. Here, $U_K$ is the terminal voltage across the electromagnet, I is the current through the electromagnet and R is the ohmic resistance of the electromagnet. By way of example, the ohmic resistance R of the electromagnet can be determined in a phase of constant current I according to $R=U_K/I$.

The dependence Ψ(I) of the magnetic flux Ψ on the current I through the electromagnet exhibits a typical ferromagnetic hysteresis loop since, in each case, magnetic energy is stored at least in the ferromagnetic core of the electromagnetic and in the likewise ferromagnetic armature. If an air gap is formed between the armature and the electromagnet on account of the armature dropping from the electromagnet into a rest position, this air gap also contains a magnetic energy contribution ΔE, which depends on the width of the air gap and consequently on the wanted armature stroke ΔH. This energy contribution ΔE manifests itself in a modification of the ferromagnetic hysteresis curve and it can consequently be evaluated from the comparison of hysteresis curves that were measured with and without an air gap.

However, once the valve is fully assembled, it is no longer possible to measure a complete hysteresis curve of the magnetic circuit with an armature permanently contacting the electromagnet. Especially in the curve portion of the hysteresis curve that represents the unsaturated state of the electromagnet, in which the flux Ψ depends substantially linearly on the current I, the restoration force of the valve, which may be a spring force, for example, dominates over the magnetic force which pulls the armature to the electromagnet. Thus, the armature returns into its rest position and the state that should actually be examined, in which the armature contacts the electromagnet, is lost. In order to record a hysteresis curve in this state, it would be necessary to mechanically fix the armature at the electromagnet against the restoration force. However, the armature is no longer accessible to this end in the fully assembled state of the valve.

The inventors have discovered that the curve portion of the hysteresis curve with an armature permanently contacting the electromagnet, which represents the unsaturated state of the electromagnet and in which the flux Ψ depends substantially linearly on the current I, can be obtained at least approximately by virtue of the electromagnet being placed against a test armature prior to the assembly in the valve and by virtue of using this to measure the hysteresis curve. This curve portion is substantially characterized by its slope $m_1$. From this, it is possible, in a number of ways, to ascertain the slope $m_1$* of the corresponding curve portion of a hysteresis curve of the fully assembled valve with an armature permanently contacting the electromagnet, which is no longer accessible to a direct measurement. In this respect, the slope $m_1$ obtained prior to the assembly of the valve is a very important reference value which, after the assembly of the valve, facilitates a measurement of the armature stroke ΔH of the valve in a particularly simple and insightful manner.

If a curve portion of a hysteresis curve representing the unsaturated state of the electromagnet is passed through in the fully assembled state of the valve, said curve portion has a slope $m_0$, which is less than the slope $m_1$*. This is caused as a result of an air gap being formed as a result of the armature dropping from the electromagnet and the energy contribution ΔE having been stored in this air gap. From the area between corresponding curve portions with slopes $m_0$ and $m_1$*, it is possible to evaluate the energy contribution ΔE and consequently, finally, the wanted armature stroke ΔH. The energy contribution ΔE is given by $$\Delta E = \frac{\Psi^2}{2}\cdot\left(\frac{1}{m_0}-\frac{1}{m_1^*}\right), \tag{1}$$

and, from this, the armature stroke ΔH emerges as $$AH = \frac{2\cdot\Delta E\cdot n^2\cdot\mu_0}{\Psi^2\cdot\left(\frac{1}{A_1}+\frac{1}{A_2}\right)} = \frac{n^2\cdot\mu_0}{\left(\frac{1}{A_1}+\frac{1}{A_2}\right)}\cdot\left(\frac{1}{m_0}-\frac{1}{m_1^*}\right). \tag{2}$$

Here, n is the number of turns of the coil of the electromagnet, $\mu_0$ is the magnetic permeability of vacuum, and $A_1$ and $A_2$ are cross-sectional areas of the air gap that are independent of its width, i.e. from the armature stroke ΔH.

Consequently, conserving $m_1$ prior to the assembly of the valve as a reference value and subsequently determining $m_1$* from $m_1$ facilitates the determination of the armature stroke ΔH of the completed valve by ascertaining $m_0$ from a further hysteresis curve. For reasons of clarity, a hysteresis curve of the magnetic circuit that is recorded in the fully assembled state of the valve is referred to as "hysteresis curve of the valve" below.

In a particularly advantageous configuration of the invention, the slope $m_1$* is ascertained by way of a specified first functional relationship from the slope $m_1$. By way of example, in the simplest approximation, the assumption can be made that $m_1$* is identical to $m_1$. This approximation is already accurate enough for many applications. However, if, for example, the valve body and/or the means for converting a movement of the armature into opening or closing of the valve now contain ferromagnetic materials, these materials influence the magnetic flux Ψ of the magnetic circuit, and hence also $m_1$*. Advantageously, the first functional relationship can be refined to the effect of taking account of this influence. The more accurately $m_1$* is determined, the more accurately the armature stroke ΔH can be determined therefrom.

In a particularly advantageous configuration of the invention, the armature is fastened to the electromagnet on at least one fully assembled valve and the hysteresis curve is recorded in this state for the purposes of ascertaining the first functional relationship. This valve is a special test or data input specimen, which differs from series-produced valves to the extent that the armature stroke ΔH is always equal to zero and the valve is unable to switch. Apart from this difference, the valve has exactly the same magnetic behavior as the series-produced valves. Ideally, the first hysteresis curve is recorded on the magnetic circuit of a valve prior to assembly and $m_1$ is determined therefrom, and the second hysteresis curve is recorded after assembling this magnetic circuit in the valve and $m_1$* is determined therefrom.

However, the slope $m_1$* can also be obtained for example from the slope $m_1$ by virtue of the influence of further ferromagnetic materials in the valve on the magnetic circuit formed by the electromagnet and armature being calculated with the aid of numerical methods, for instance the finite element method.

Alternatively, or in combination herewith, it is also possible to refine $m_1$* by comparing reference values of further variables ascertained prior to the assembly of the valve to values of these variables ascertained after the assembly of the valve.

Therefore, in a further particularly advantageous configuration of the invention, the slope $m_2$ of a second linear curve portion of the hysteresis curve, which is recorded on the combination of the electromagnet with the test armature, is additionally ascertained in the saturated state prior to inserting the electromagnet into the valve body. Furthermore, advantageously, the current $I_0$ at which a linear continuation of the second curve portion toward the current axis I intersects the current axis I is additionally ascertained.

Both variables are also accessible to measurement in the fully assembled valve because the armature is attracted to the electromagnet in the saturated state of the electromagnet, and so the magnetic circuit, in this respect, is in the same state as during the reference measurement on the combination of the electromagnet and the test armature.

In order to obtain a comparison value corresponding to $m_2$ after the assembly of the valve, a further magnetic hysteresis curve of the valve is advantageously recorded after assembling the valve. The slope $m_3$ of a second, substantially linear curve portion of the further magnetic hysteresis curve, which represents the saturated state, is ascertained. This second curved portion corresponds to the second curved portion of the magnetic hysteresis curve measured prior to the assembly of the valve on the combination of electromagnet and test armature.

Furthermore, in order to obtain a comparison value corresponding to $I_0$ after the assembly of the valve, the current $I_1$ at which a linear continuation of the second curve portion toward the current axis I intersects the current axis I is advantageously additionally ascertained. The inventors have recognized that the comparison of the current $I_1$ to the current $I_0$ offers an additional option of quality control for the magnetic properties of the components used in the valve. In particular, it is possible to monitor whether the armature and/or a residual air gap disk (RLSS) arranged between the armature and the electromagnet corresponds to the desired specification. A large deviation between the current $I_1$ and the current $I_0$ may indicate an anomaly in this respect or else an unwanted particle formation on the contact faces on the residual air gap disk with the armature and/or the electromagnet.

Therefore, in a further particularly advantageous configuration of the invention, the difference in terms of magnitude ΔI between the current $I_1$ and the current $I_0$ is ascertained and the valve is classified as faulty if this difference in terms of magnitude exceeds a specified threshold value.

In a further particularly advantageous configuration of the invention, a correlation and/or a second functional relationship between the slopes $m_1$ and $m_2$ is ascertained from the slopes $m_1$ and $m_2$. Advantageously, the second functional relationship establishes a linear relationship between the ratio $m_2/m_1$ and the current value $I_0$. By way of example, it is possible to establish a parameterized approach of the form $$I_0 = k_0 \cdot \frac{m_2}{m_1} + k_0, \tag{3}$$

for the functional relationship with the two parameters $k_0$ and $k_1$.

In mass examinations of electromagnets, the inventors have recognized that $m_1$, $m_2$, and $I_0$, on their own, are subject to individual variations. However, the correlation between $m_1$, $m_2$, and $I_0$ according to equation (3) with the same parameters $k_0$ and $k_1$ is valid, to a good approximation, within one batch of electromagnets with nominally the same geometry, which were manufactured in nominally identical fashion. The most important manufacturing parameters that have an influence on the parameters $k_0$ and $k_1$ are the magnetic powder used for the production of the magnetic core of the electromagnet, the compressed density, and a possible heat treatment of the magnetic core.

One approach for refining the original approximation that the reference value $m_1$ that was ascertained prior to the assembly of the valve can still be used without change as the slope $m_1$* after the assembly of the valve, therefore consists of not using the reference value $m_1$ when evaluating the energy contribution ΔE and the armature stroke ΔH according to equations (1) and (2) directly but of determining $m_1$* with the aid of the second functional relationship between $m_1$ and $m_2$, and optionally $I_0$ as well. By way of example, if the approach according to equation (3) is used to this end, the functional relationship is characterized by the parameters $k_0$ and $k_1$.

The parameters $k_0$ and $k_1$, obtained prior to the assembly of the valve, can be used, for example, by virtue of the slope $m_3$ of a curve portion of the hysteresis curve that represents the saturated state being ascertained at the fully assembled valve and inserted in equation (3) as $m_2$. Then, according to $$m_1^* = \frac{k_1 \cdot m_3}{I_0 - k_0}, \tag{4}$$

a refined approximate value for $m_1$* is obtainable in the fully assembled state of the valve, said approximate value being closer to the value that is no longer directly accessible to measurement than the reference value $m_1$ obtained from the combination of electromagnet and test armature prior to the assembly of the valve.

Together with the value for $m_0$ that was obtained in the dropped state of the armature in the fully assembled valve, the refined approximate value for $m_1$* can be used to evaluate the energy contribution ΔE and, finally, the armature stroke ΔH according to equations (1) and (2).

In a further particularly advantageous configuration of the invention, the slope $m_1$, the slope $m_2$, the slope $m_1$*, and/or the first functional relationship, and/or the second functional relationship, and/or the correlation between the slopes $m_1$ and $m_2$ is noted on the electromagnet, and/or on a machine-readable information carrier connected to the electromagnet and/or unambiguously linked to the electromagnet in a database. In particular, the functional relationship according to equation (3) can be represented by the parameters $k_0$ and $k_1$. Then, the mass production of electromagnets can be decoupled from the mass production of the electromagnetically actuatable valves in a particularly simple manner. By way of example, one plant can produce electromagnets for a plurality of different plants in advance, said plurality of other plants using this to produce different types of electromagnetically actuatable valves. By way of example, the machine-readable information carrier may contain a data matrix code, for instance a QR code.

The decoupling of the production of electromagnets on the one hand and valves on the other hand can be simplified in a further particularly advantageous configuration of the invention by virtue of a multiplicity of electromagnets being classified according to the value of the slopes $m_1$ and/or $m_2$, and/or according to the functional relationship and/or the correlation between the slopes $m_1$ and $m_2$. By way of example, the functional relationship can be classified on the basis of the parameters $k_0$ and $k_1$ in equation (3). The classification discretizes the accuracy of the reference values for the electromagnets but accelerates the mass production as electromagnets from one class can be processed further in identical form in each case and it is no longer necessary to consider magnet-individual reference values. Furthermore, it is possible to reject conspicuous electromagnets, which cannot be assigned to any class according to the specification, in advance.

According to what was said previously, the invention also relates to a method for determining the armature stroke ΔH on an electromagnetically actuatable valve. This valve comprises an electromagnet, an armature that is movable by the electromagnet, and preferably a valve body within which the electromagnet, the armature, and means for converting a movement of the armature into an opening or closing of the valve are arranged. For the purposes of determining the armature stroke ΔH, a magnetic hysteresis curve of the valve is recorded and a first slope $m_0$ of a first linear curve portion of the hysteresis curve of the valve in the unsaturated state is determined. In this state, the armature has dropped off the electromagnet as a result of the restoration force active in the valve, and so there is an air gap between the armature and the electromagnet.

According to the invention, the magnetic energy ΔE in the air gap is evaluated from the difference between the first slope $m_0$ and a second slope $m_1$* of the first, substantially linear curve portion, corresponding to the first curve portion of the hysteresis curve, of a further magnetic hysteresis curve, which the valve would have in the case of an armature secured on the electromagnet, for the purposes of determining the armature stroke ΔH. Here, for the purposes of ascertaining the second slope $m_1$*, at least one reference value $m_1$ that was ascertained prior to inserting the electromagnet into the valve body can be used for said slope $m_1$*. In particular, the reference valve $m_1$ could have been established within the scope of the above-described production method.

The methods disclosed in conjunction with the production method, for example, are available for the purposes of ascertaining $m_1$* using the reference value $m_1$.

In a further particularly advantageous configuration of the invention, the second slope $m_1$ is ascertained from the slope $m_3$ of a second linear curve portion of the magnetic hysteresis curve of the valve in the saturated state in conjunction with a functional relationship and/or a correlation between the slopes $m_1$, $m_2$ of the curve portions of the further hysteresis curve. Here, the correlation or functional relationship may likewise have been ascertained prior to inserting the electromagnet into the valve body and conserved as a reference value.

By way of example, the functional relationship according to equation (3) may have been conserved in the form of the parameters $k_0$ and $k_1$.

The production method used to obtain and conserve one or more reference values on the electromagnet prior to the assembly of the valve and the measurement method used to evaluate the armature stroke ΔH advantageously using these reference values about the magnetic energy ΔE in the air gap between armature and electromagnet after the assembly of the valve synergistically work hand-in-hand in order, in end effect, to facilitate an accurate determination of the armature stroke ΔH. The influence of batch variations of the employed components on the accuracy of the determined armature stroke ΔH is minimized by the advantageously complete measurement of hysteresis curves on all employed electromagnets (magnetic assemblies) and by the conservation of the reference values obtained during this measurement. The armature stroke AH determined according to the invention can be advantageously used, in particular, as feedback in order to precisely set the armature stroke at the plant when manufacturing electromagnetically actuatable valves for fuel injectors and in order to monitor said armature stroke during running operation.

BRIEF DESCRIPTION OF THE DRAWINGS

Further measures that improve the invention are illustrated in more detail below, together with the description of the preferred exemplary embodiments of the invention on the basis of the figures.

In the figures.

DETAILED DESCRIPTION

Figure 1A:
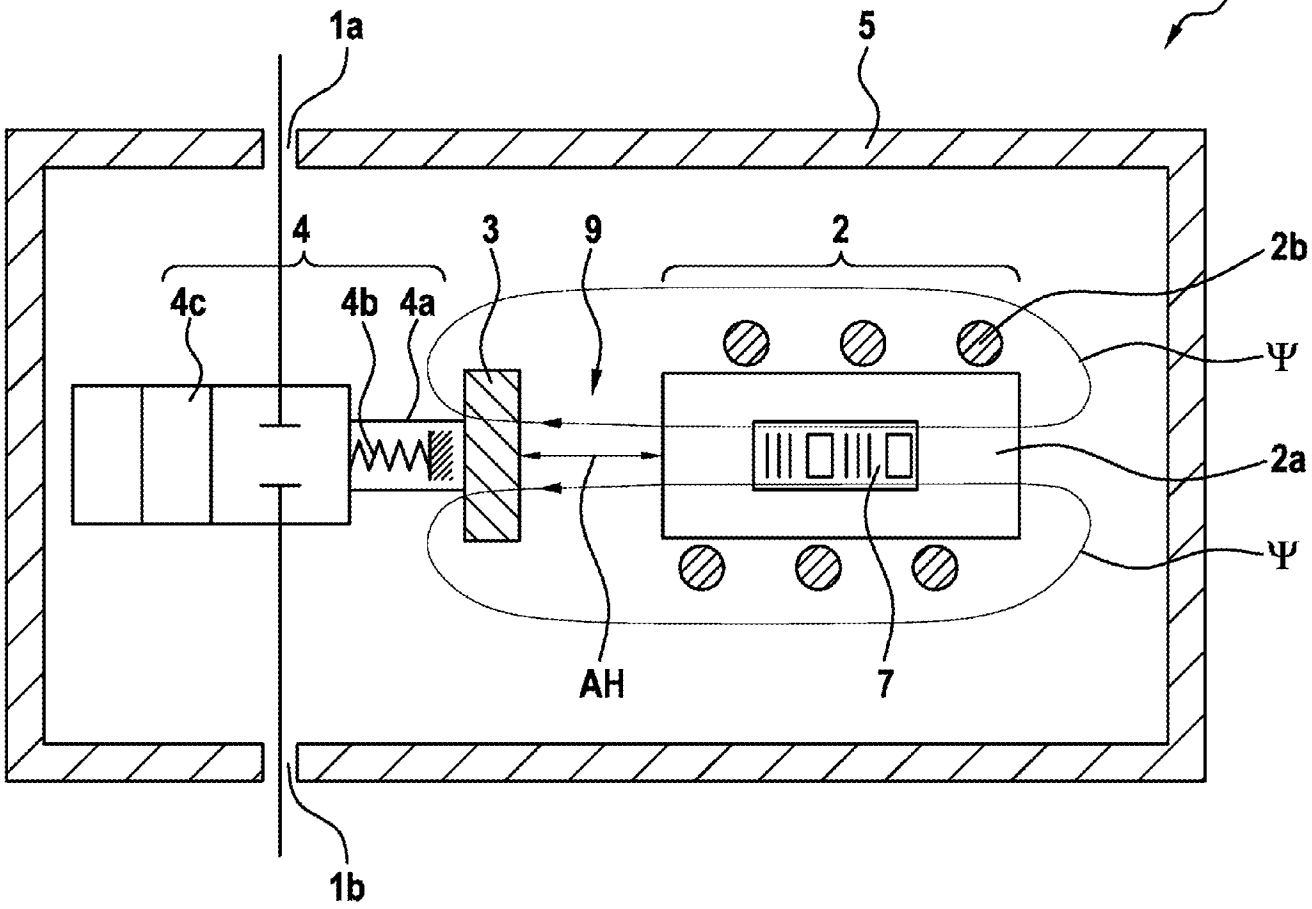
FIG. 1*a* shows a schematic illustration of an electromagnetically actuatable valve.

According to FIG. 1*a*, the valve 1, illustrated here in an exemplary manner as a 2/2 valve, comprises a valve body 5 with an inlet 1*a* and an outlet 1*b*. The valve 1 controls the through-flow of a medium between the inlet 1*a* and the outlet 1*b*. To this end, an electromagnet 2 is arranged within the valve body 5, said electromagnet consisting of a ferromagnetic magnetic core 2*a* and a coil 2*b* wound on the ferromagnetic magnetic core 2*a*. Attached to the electromagnet 2 is a machine-readable information carrier 7, which contains a barcode with reference values. These reference values were measured on a combination 6 of the electromagnet 2 with a test armature 3*a* prior to the insertion of the electromagnet 2 into the valve body 5.

In the valve 1, an armature 3 is arranged relative to the electromagnet 2 in such a way that the electromagnet 2 can attract the armature 3. Then, the actuator 4*c* of the valve 1 is transferred by way of a coupling mechanism 4*a* from the position shown in FIG. 1*a*, in which the valve 1 is closed, into the position not shown in FIG. 1*a*, in which the valve 1 is open, against the restoration force exerted by the valve spring 4*b*. Together, the coupling mechanism 4*a*, the valve spring 4*b* and the actuator 4*c* form the means 4 for converting the movement of the armature 3 into opening or closing of the valve 1.

In the closed position of the valve 1, shown in FIG. 1*a*, there is an air gap 9 between the armature 3 and the electromagnet 2. By contrast, if the armature 3 is attracted to the electromagnet 2, this air gap 9 vanishes. The width of the air gap 9 in the closed position, in which the armature 3 has dropped off the electromagnet 2, corresponds to the armature stroke AH of the valve 1.

Together, the electromagnet 2 and the armature 3 form a magnetic circuit which is permeated by magnetic flux Ψ. Two flux lines of this magnetic flux are plotted in FIG. 1*a* in an exemplary manner.

Figure 1B:
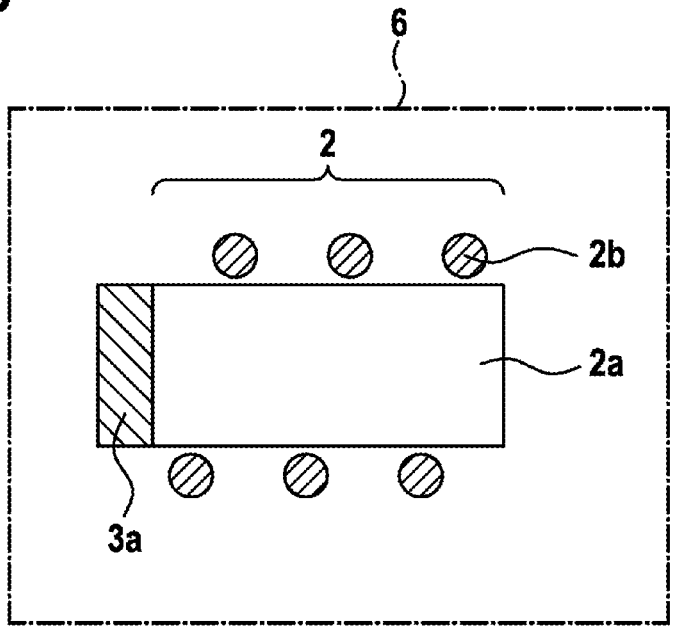
FIG. 1*b* shows a combination of electromagnet and test armature.

FIG. 1*b* shows the combination 6 of the electromagnet 2 and the test armature 3*a*, using which at least the slope $m_1$ of a curve portion 11 of a hysteresis curve 10 in the unsaturated state is ascertained as a reference value. The test armature 3*a* is held in contact with the magnetic core 2*a* of the electromagnet 2 by means that are not illustrated in FIG. 1*b*, even if there is no current passing through the coil 2*b* of the electromagnet 2.

Figure 2:
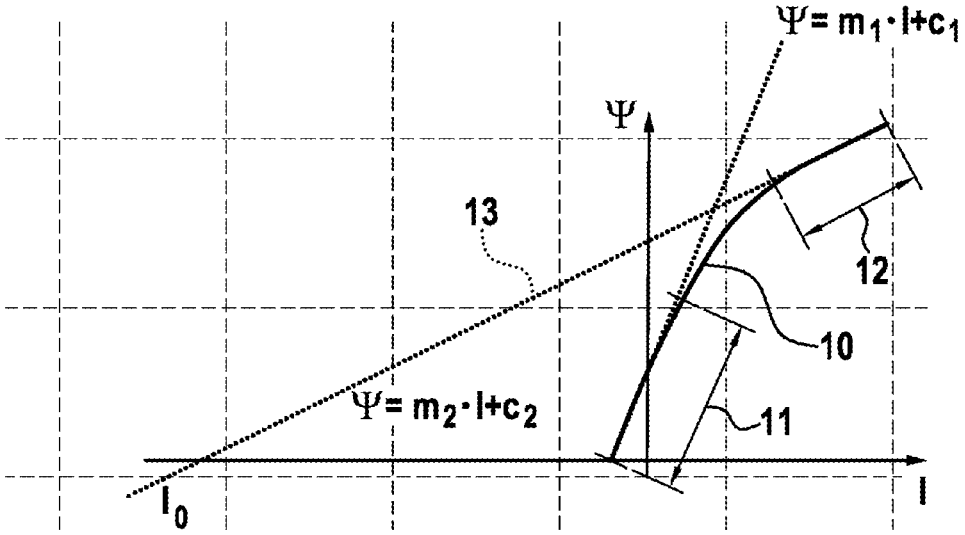
FIG. 2 shows a section of the hysteresis curve measured on the combination.

FIG. 2 shows a section of the hysteresis curve 10 that was recorded on the combination 6 of the electromagnet 2 and the test armature 3*a*. The magnetic flux Ψ is plotted against the current I through the coil 2*b* of the electromagnet 2. In a first curve portion 11, which represents the unsaturated state of the electromagnet 2, the hysteresis curve 10 extends substantially linearly with a slope $m_1$, and so $\Psi(I)=m_1 \cdot I+c_1$ with a constant $c_1$ applies approximately in this curve portion 11. In a second curve portion 12, which represents the saturated state of the electromagnet 2, the hysteresis curve 10 likewise extends substantially linearly with a slope $m_2$, and so $\Psi(I)=m_2 \cdot I+c_2$ with a constant $c_2$ applies approximately in this curve portion 12. A linear continuation 13 of this second curve portion 12 with the same slope $m_2$ toward the current axis I intersects the current axis I at the current value $I_0$. The section of the hysteresis curve 10 illustrated in FIG. 2 was recorded proceeding from the saturated state of the electromagnet 2. Thus, proceeding from the highest current I through the coil 2*b* of the electromagnet 2, the current I was successively reduced.

Figure 3:
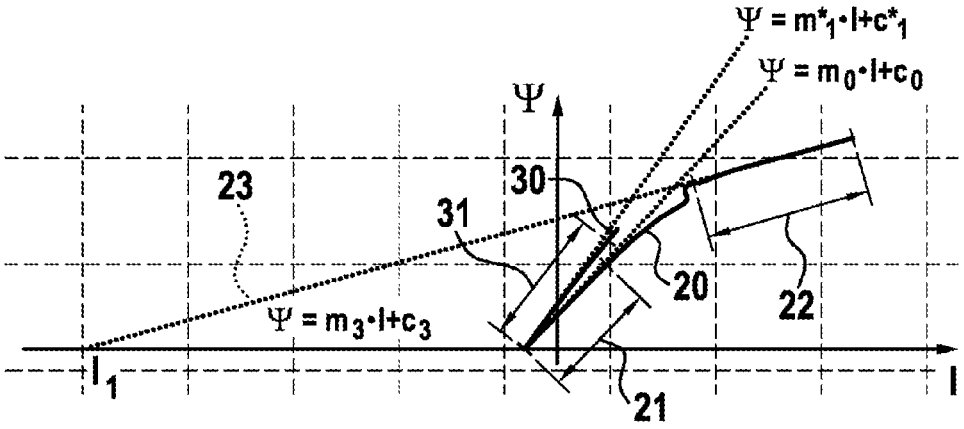
FIG. 3 shows a section of the hysteresis curve measured on the fully assembled valve.

FIG. 3 shows a section of the hysteresis curve 20 that was recorded on the fully assembled valve 1. In a manner analogous to FIG. 1, the magnetic flux Ψ in the magnetic circuit of the valve 1 formed by the electromagnet 2 and armature 3 is plotted against the current I through the coil 2*b* of the electromagnet 2. In a manner analogous to FIG. 1, the current I was successively reduced starting from the highest value of the current I in the saturated state of the electromagnet 2.

In the unsaturated state, the hysteresis curve 20 also has a first curve portion 21, in which it extends substantially linearly with a slope $m_0$. Thus, $\Psi(I)=m_0 \cdot I+c_0$ with a constant $c_0$ applies approximately in this curve portion 21. In a second curve portion 22, which represents the saturated state, the hysteresis curve 20 likewise extends substantially linearly with a slope $m_3$. In this curve portion 22, $\Psi(I)=m_3 \cdot I+c_3$ with a constant $c_3$ applies approximately. The linear continuation 23 of the curve portion 22 with the same slope $m_3$ toward the current axis I intersects the current axis I at the current value $I_1$.

For comparison purposes, FIG. 3 additionally plots the curve portion 31 of the hysteresis curve 30 shown in FIG. 2, which the fully assembled valve would have in the case of an armature permanently in contact with the electromagnet. In this curve portion 31, $\Psi(I)=m_1^* \cdot I+c_1^*$ applies approximately with a constant $c_1^*$.

It is clear from the profile of the hysteresis curve 20 proceeding from the second curve portion 22 toward lower current values I that the armature 3 dropping off the electromagnet 2 reduces the magnetic flux Ψ in a discontinuous fashion. The reason for this is that the air gap 9 forms between the armature 3 and the electromagnet 2 as a result of the armature 3 dropping off and magnetic energy ΔE is stored in the air gap 9. This energy ΔE corresponds to the area between the first curve portion 21 of the hysteresis curve 20 and the first curve portion 31 of the hysteresis curve 30. The wanted armature stroke ΔH is establishable from the energy ΔE.

Figure 4:
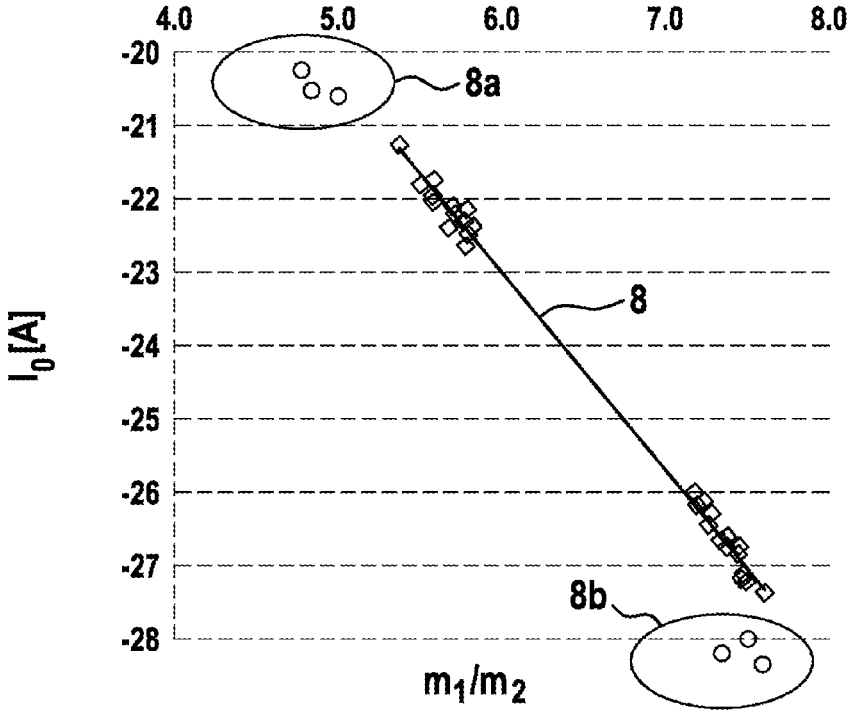
FIG. 4 shows the functional relationship between the slope ratio and the current, ascertained in a mass examination of electromagnets.

FIG. 4 shows a second functional relationship 8 between the slope ratio $m_2/m_1$ and the current $I_0$, said functional relationship having been ascertained in mass examinations of electromagnets 2. The second functional relationship 8 corresponds to equation (3). Each measurement point characterized by a rhombus as a symbol represents an electromagnet 2 for which the second functional relationship 8 approximately applies. Each measurement point characterized by a circle as a symbol represents an electromagnet 2 that significantly deviates from the second functional relationship 8. Two groups 8*a* and 8*b* of such outliers can be identified in FIG. 4. Electromagnets 2 that are conspicuous in this manner are preferably sorted out as rejects.

Figure 5:
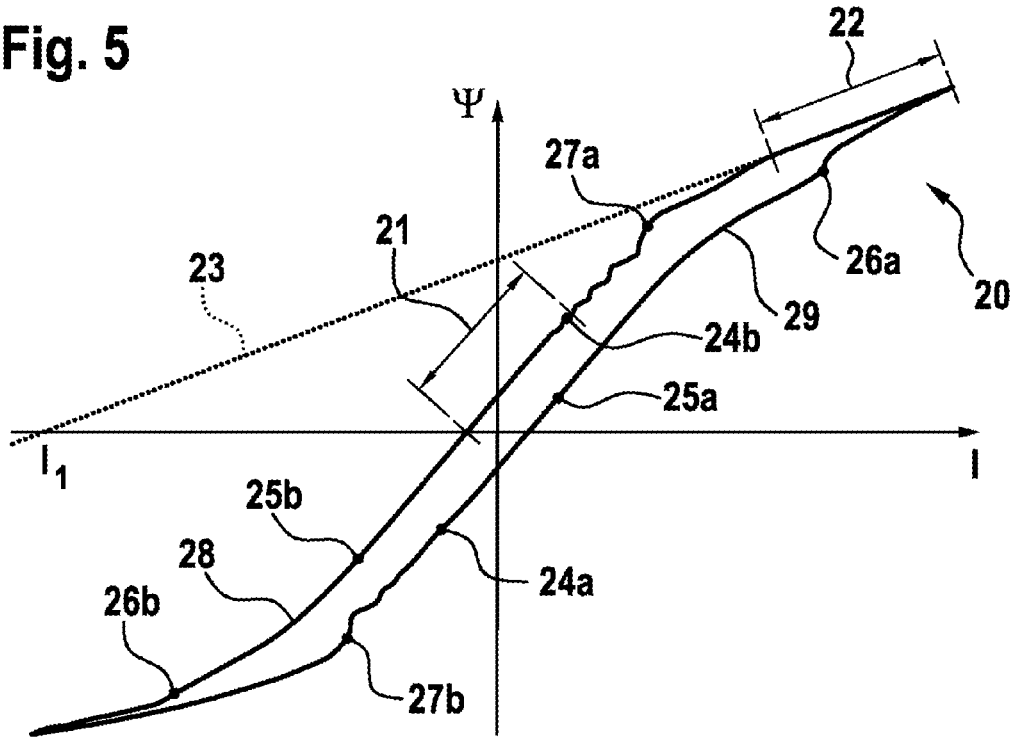
FIG. 5 shows a complete hysteresis curve of the valve.

For better understanding, FIG. 5 shows a complete hysteresis curve 20 of the valve 1 in the case of symmetric control. Proceeding from the highest current value I in the saturated state, the branch 28 is initially passed over to lower currents I. In the process, the substantially linearly extending second curve portion 21 is passed over first. Following this second curved portion 21, the magnetic flux Ψ in the descending curve portion 24 reduces superlinearly before, at the point 27*a*, the armature 3 drops off the electromagnet 2 as a result of the restoration force exerted by the valve spring 4*b* of the valve 1 and the air gap 9 is formed between the armature 3 and the electromagnet 2. This manifests itself in a discontinuous drop in the magnetic flux T. Subsequently, the branch 28 of the hysteresis curve 20 merges into the first curve portion 21 in the unsaturated state. Here, the curve of the magnetic flux Ψ is approximately linear in relation to the current I.

In the lower left quadrant of FIG. 5, the branch 28 of the hysteresis curve 20 merges into an attracting curve portion. At the point 26*b*, the armature 3 is attracted to the electromagnet 2, which manifests itself in a small discontinuity in the curve profile.

If the current I is subsequently increased again in the saturated state, the branch 29 of the hysteresis curve 20 is passed over. Here, the hysteresis curve 20 merges again into a decreasing curve portion 24, in which the armature 3 drops off the electromagnet 2 at the point 27*b*. When the branch 29 of the hysteresis curve 29 passes over into the upper right-hand quadrant, the next attracting curve portion 25 starts. At the point 26*a*, the armature 3 is attracted to the electromagnet 2 again.

In a manner analogous to FIG. 3, the linear continuation 23 of the second curve portion 21 toward the current axis I and the current value $I_1$, at which the continuation 23 intersects the current axis I, are also plotted in FIG. 5.

On the basis of a few examples, FIG. 6 elucidates how the individual variation between the various electromagnets 2 can influence the profile of the hysteresis curve 10 of a combination 6 of the respective electromagnet 2 with the test armature 3*a*.

Figure 6A:
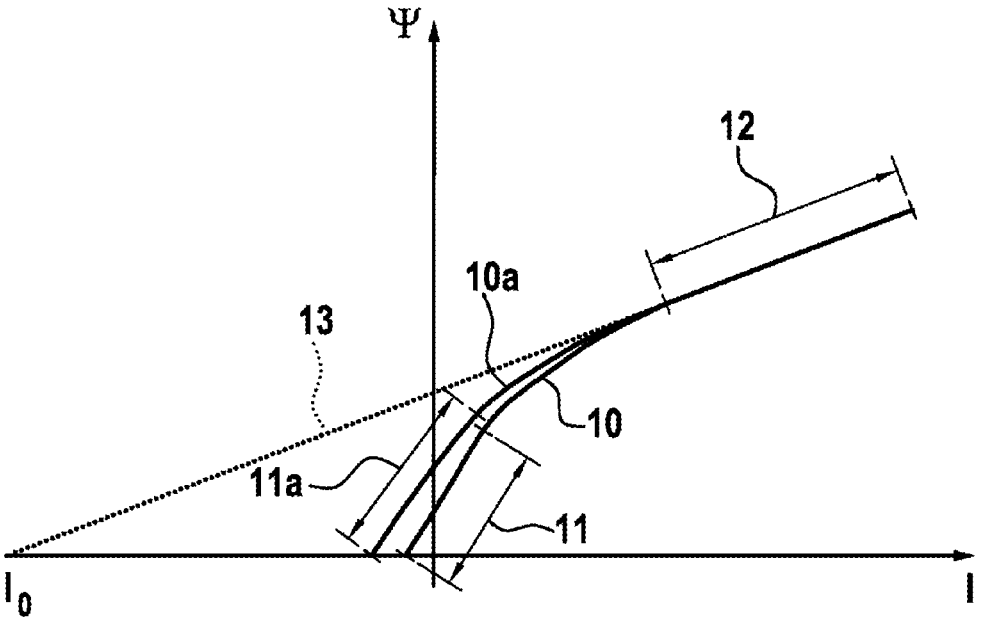
FIG. 6*a* shows deviations between a first hysteresis curve and a second hysteresis curve.

FIG. 6*a* shows deviations between a first hysteresis curve 10 and a second hysteresis curve 10*a* of the type that may be caused, for example, by differences in the heat treatment of the magnetic cores 2*a* of different electromagnets 2, or else by a different chemical composition of the magnetic powder used for both magnetic cores 2*a*. In the saturated state, which is represented by the second curve portion 12, the profiles of the two hysteresis curves 10 and 10*a* are identical. Consequently, the deviation in the composition of the magnetic cores 2*a* does not modify the slope $m_2$ in the second curve portion 12 and does not modify the current $I_0$, at which the linear continuation 13 of the second curve portion 12 intersects the current axis I, either. However, the profiles of the first curve portions 11 and 11*a* in the unsaturated state are different and, in particular, also have different slopes $m_1$.

Figure 6B:
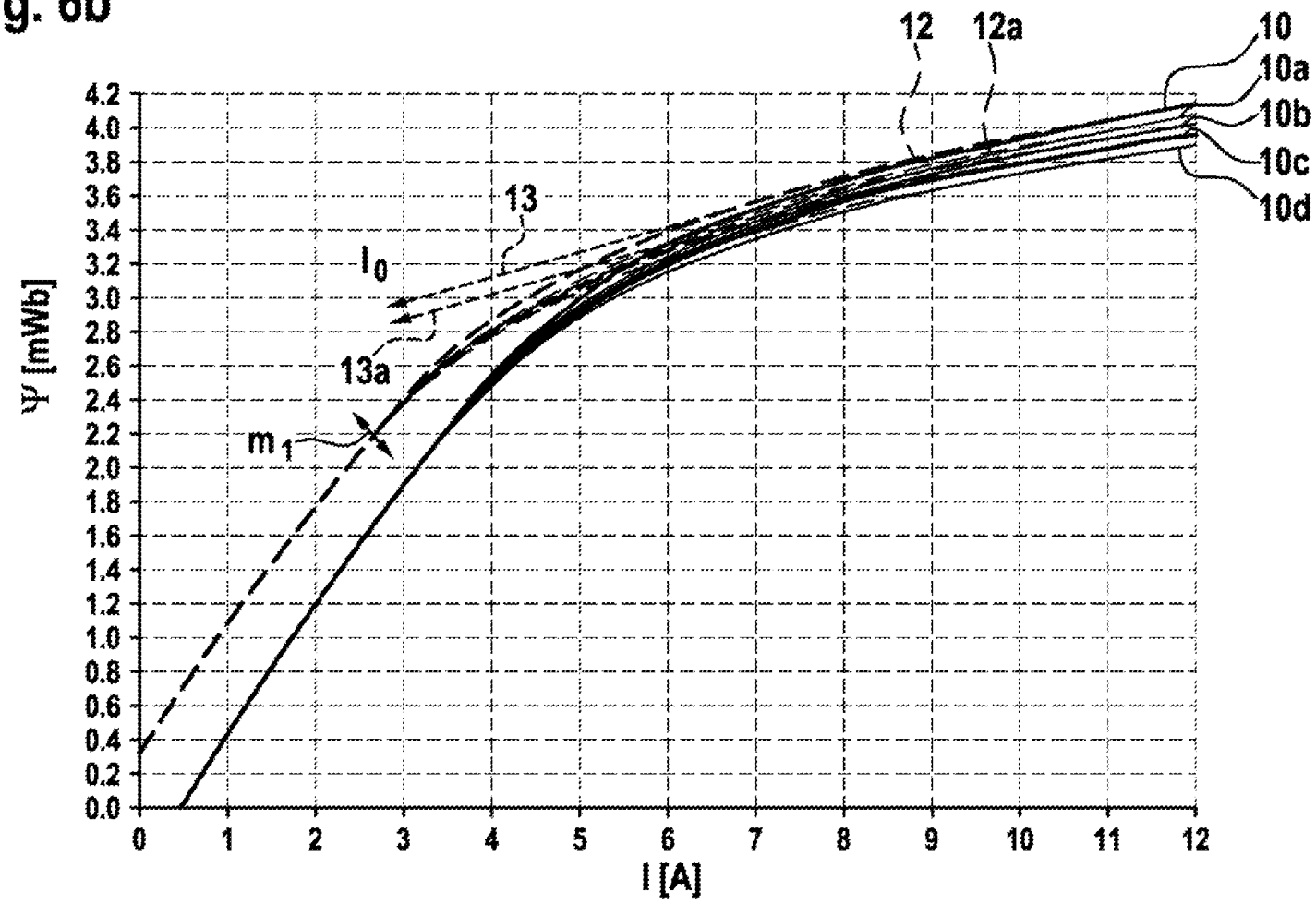
FIG. 6*b* shows the reverse case where, within a batch of five electromagnets, the respective hysteresis curves measured in the combination with a test armature only differ significantly in the saturated state, while the hysteresis curves extend practically parallel to one another in the unsaturated state.

FIG. 6*b* shows the reverse case where, within a batch of five electromagnets 2, the respective hysteresis curves 10, 10*a*-10*d* measured in the combination 6 with a test armature 3*a* only differ significantly in the saturated state, while the hysteresis curves 10, 10*a*-10*d* extend practically parallel to one another in the unsaturated state. Thus, for example, the second curve portions 12 and 12*a* of the hysteresis curves 10 and 10*a* have different slopes $m_2$ in the saturated state and the linear continuations 13 and 13*a* of these two curve portions 12 and 12*a* in the direction of the current axis I intersect the current axis I with different currents $I_0$. By contrast, the slope $m_1$ in the unsaturated state is virtually identical for all hysteresis curves 10, 10*a*-10*d*.

Figure 6C:
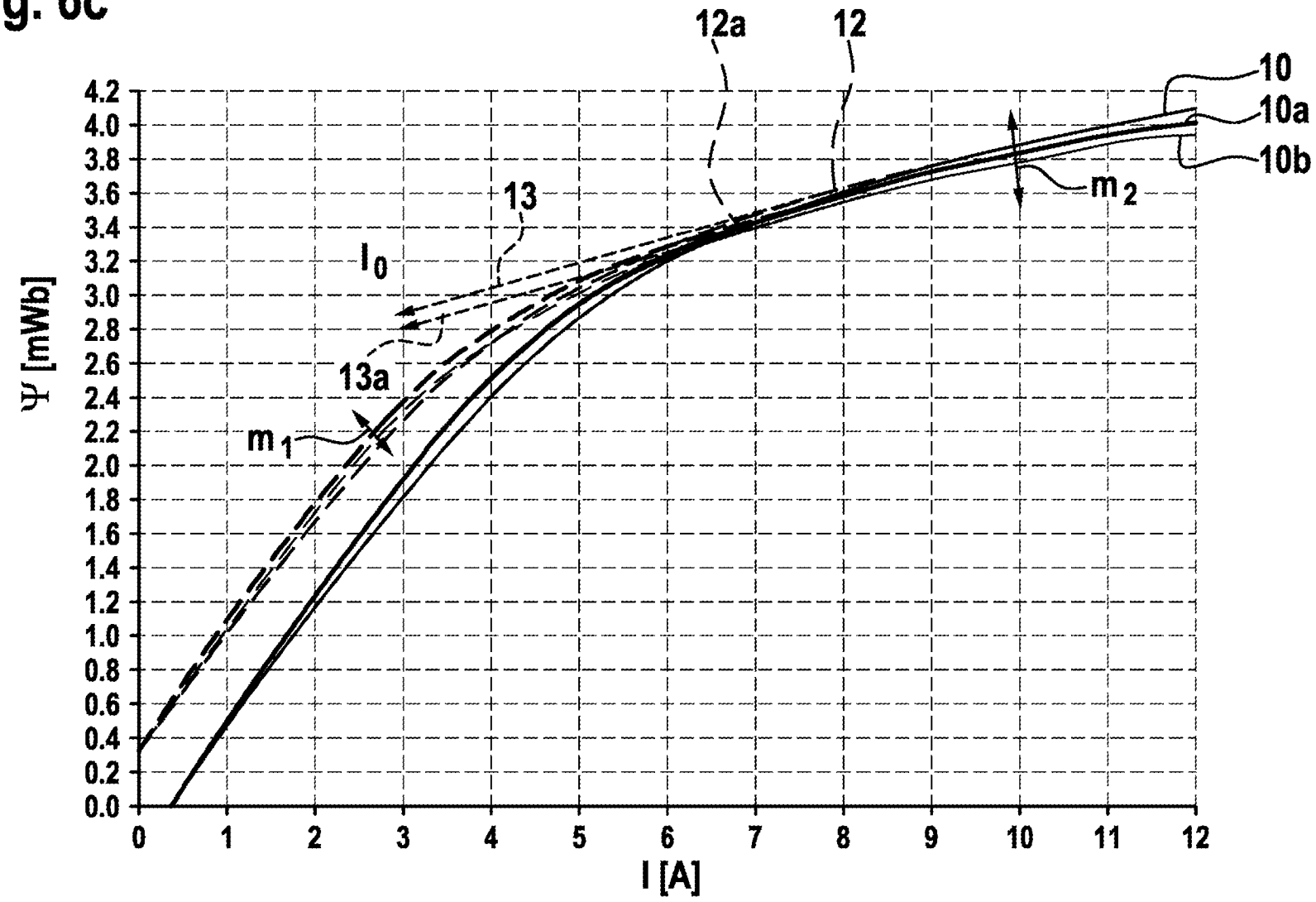
FIG. 6*c* shows the case where, within a batch of three electromagnets, the respective hysteresis curves measured in the combination with a test armature differ significantly both in terms of their slopes in the unsaturated range and in terms of their slopes in the second curve portions in the saturated range.

By contrast, FIG. 6*c* shows the case where, within a batch of three electromagnets 2, the respective hysteresis curves 10, 10*a*, 10*b* measured in the combination 6 with a test armature 3*a* differ significantly both in terms of their slopes $m_1$ in the unsaturated range and in terms of their slopes $m_2$ in the second curve portions 12, 12*a* in the saturated range. Accordingly, the linear continuations 13, 13*a* of the second curve portions 12, 12*a* in the direction of the current axis I also intersect the current axis I at different currents $I_0$.

Provided that the individual variation between electromagnets 2 only manifests itself in such modifications of the hysteresis curve 10, which modify $m_1$, $m_2$, and $I_0$ in a correlated manner, the production method can be applied in a simplified form. Then, it is possible to dispense with recording a hysteresis curve 10 for each individual electromagnet 2. Instead, it is sufficient to measure a sample of a few electromagnets 2 of a batch of the nominally identically dimensioned and manufactured electromagnets 2 and ascertain the functional relationship 8 according to equation (3) therefrom. By way of example, it is possible, for this sample, to use reference valves in which the armature 3 is attached to the electromagnet 2 as a test armature 3*a*. Then, $m_1$ can be evaluated for all further electromagnets 2 of the batch according to equation (4).

The invention claimed is:

1. A method for ascertaining a hysteresis curve of an electromagnetically actuatable valve (1) made of an electromagnet (2, 2*a*, 2*b*), an armature (3) that is movable by way of the electromagnet (2, 2*a*, 2*b*), and a valve body (5) with means (4, 4*a*, 4*b*, 4*c*) for converting a movement of the armature (3) into opening or closing of the valve (1), wherein the electromagnet (2, 2*a*, 2*b*) and the armature (3) are inserted into the valve body (5), the method comprising recording a magnetic hysteresis curve (10) of a combination (6) of the electromagnet (2, 2*a*, 2*b*) with a test armature (3*a*) contacting said electromagnet (2, 2*a*, 2*b*) prior to inserting the electromagnet (2, 2*a*, 2*b*) into the valve body (5), ascertaining the slope $m_1$ of a first, substantially linear curve portion (11) of the hysteresis curve (10) in an unsaturated state, and ascertaining, from the slope $m_1$, the slope $m_1$* of a curve portion (31), corresponding to the first curve portion (11), of a hysteresis curve (30) of the fully assembled valve (1) with an armature (3) permanently in contact with the electromagnet (2, 2*a*, 2*b*).

2. The method as claimed in claim 1, characterized in that the slope $m_1$* is ascertained by way of a specified first functional relationship from the slope $m_1$.

3. The method as claimed in claim 2, characterized in that the armature (3) is fastened to the electromagnet (2, 2*a*, 2*b*) on at least one fully assembled valve (1) and the hysteresis curve (30) is recorded in this state for the purposes of ascertaining the first functional relationship.

4. The method as claimed in claim 1, characterized in that the slope $m_2$ of a second, substantially linear curve portion (12) of the hysteresis curve (10) of the combination (6) is additionally ascertained in the saturated state prior to inserting the electromagnet (2, 2*a*, 2*b*) into the valve body (5).

5. The method as claimed in claim 4, characterized in that the current $I_0$ at which a linear continuation (13) of the second curve portion (12) toward the current axis I intersects the current axis I is additionally ascertained.

6. The method as claimed in claim 4, characterized in that a further magnetic hysteresis curve (20) of the valve (1) is recorded after assembling the valve (1), wherein the slope $m_3$ of a second, substantially linear curve portion (22) of the further magnetic hysteresis curve (20), corresponding to the second curve portion (12) of the magnetic hysteresis curve (10), in the saturated state is ascertained.

7. The method as claimed in claim 6, characterized in that the current $I_1$ at which a linear continuation (23) of the second curve portion (22) toward the current axis I intersects the current axis I is additionally ascertained.

8. The method as claimed in claim 7, characterized in that the difference in terms of magnitude ΔI between the current $I_1$ and the current $I_0$ is ascertained and the valve (1) is classified as faulty if the difference in terms of magnitude ΔI exceeds a specified threshold value.

9. The method as claimed in claim 2, characterized in that a correlation and/or a second functional relationship (8) between the slopes $m_1$ and $m_2$ is ascertained from the slopes $m_1$ and $m_2$.

10. The method as claimed in claim 9, characterized in that the second functional relationship (8) establishes a linear relationship between the ratio $m_2/m_1$ and the current value $I_0$.

11. The method as claimed in claim 1, characterized in that the slope $m_1$, the slope $m_2$, the slope $m_1$*, and/or the first functional relationship, and/or the second functional relationship (8), and/or the correlation between the slopes $m_1$ and $m_2$ is noted on the electromagnet (2, 2*a*, 2*b*), and/or on a machine-readable information carrier (7) connected to the electromagnet (2, 2*a*, 2*b*) and/or unambiguously linked to the electromagnet (2, 2*a*, 2*b*) in a database.

12. The method as claimed in claim 1, characterized in that a multiplicity of electromagnets (2, 2*a*, 2*b*) are classified according to the value of the slopes $m_1$ and/or $m_2$, and/or according to the second functional relationship (8) and/or the correlation between the slopes $m_1$ and $m_2$.

13. A method for determining an armature stroke (AH) on an electromagnetically actuatable valve (1) comprising an electromagnet (2, 2*a*, 2*b*) and an armature (3) that is movable by the electromagnet (2, 2*a*, 2*b*), the method comprising recording a magnetic hysteresis curve (20) of the valve (1), determining a first slope $m_0$ of a first, substantially linear curve portion (21) of the hysteresis curve (20) of the valve (1) in the unsaturated state, and evaluating the magnetic energy ΔE in the air gap (9) formed between the armature (3) and the electromagnet (2, 2*a*, 2*b*) from the difference between the first slope $m_0$ and a second slope $m_1$* of the first, substantially linear curve portion (11), corresponding to the first curve portion (21) of the hysteresis curve (20), of a further magnetic hysteresis curve (10), which the valve (1) would have in the case of an armature (3) secured on the electromagnet (2, 2*a*, 2*b*).

14. The method as claimed in claim 13, wherein the valve (1) comprises a valve body (5) and wherein the electromagnet (2, 2*a*, 2*b*), the armature (3), and means (4, 4*a*, 4*b*, 4*c*) for converting a movement of the armature (3) into an opening or closing of the valve (1) are arranged within the valve body (5), characterized in that, for the purposes of ascertaining the second slope $m_1$*, at least one reference value $m_1$ that was ascertained prior to inserting the electromagnet (2, 2*a*, 2*b*) into the valve body (5) is used for said slope $m_1$*.

15. The method as claimed in claim 13, characterized in that the second slope $m_1$* is ascertained from the slope $m_3$ of a second linear curve portion (22) of the magnetic hysteresis curve (20) of the valve (1) in the saturated state in conjunction with a second functional relationship (8) and/or a correlation between the slopes $m_1$, $m_2$ of curve portions (11, 12) of the further hysteresis curve (10).

* * * * *